US009243765B2

(12) United States Patent
Roeckl et al.

(10) Patent No.: US 9,243,765 B2
(45) Date of Patent: Jan. 26, 2016

(54) EXTERIOR LIGHT FOR A MOTOR VEHICLE, AND A METHOD FOR MANUFACTURING SUCH A LIGHT

(71) Applicant: GM GLOBAL TECHNOLOGY OPERATIONS LLC, Detroit, MI (US)

(72) Inventors: Philipp Roeckl, Aschaffenburg (DE); Frank Langkabel, Ruesselsheim (DE); Serkan Proepper, Weiler bei Bingen (DE); Rouven Haberkorn, Darmstadt (DE); Ingolf Schneider, Ruesselsheim (DE); Heiko Eckert, Bingen-Buedesheim (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 150 days.

(21) Appl. No.: 14/136,591

(22) Filed: Dec. 20, 2013

(65) Prior Publication Data

US 2014/0177247 A1 Jun. 26, 2014

(30) Foreign Application Priority Data

Dec. 20, 2012 (DE) ..... 10 2012 024 977

(51) Int. Cl.
*F21V 1/00* (2006.01)
*F21S 8/10* (2006.01)

(52) U.S. Cl.
CPC ..... *F21S 48/10* (2013.01); *F21S 48/1104* (2013.01); *F21S 48/115* (2013.01); *F21S 48/1163* (2013.01); *F21S 48/1208* (2013.01); *F21S 48/1305* (2013.01); *F21S 48/211* (2013.01); *F21S 48/215* (2013.01); *F21S 48/217* (2013.01); *F21S 48/2206* (2013.01); *F21S 48/232* (2013.01); *Y10T 29/4913* (2015.01)

(58) Field of Classification Search
CPC ..... F21V 17/00; F21V 29/00; F21K 9/00
USPC ..... 362/509, 508, 523, 549
See application file for complete search history.

(56) References Cited

U.S. PATENT DOCUMENTS

| | | | | |
|---|---|---|---|---|
| 7,621,658 | B2 | 11/2009 | Groetsch et al. | |
| 7,948,694 | B2 * | 5/2011 | Bogner et al. | 359/819 |
| 7,985,015 | B2 | 7/2011 | Tasch et al. | |
| 8,641,460 | B2 * | 2/2014 | Koyama et al. | 439/877 |

(Continued)

FOREIGN PATENT DOCUMENTS

| | | | |
|---|---|---|---|
| DE | 102004020493 | A1 | 11/2005 |
| DE | 102007034123 | A1 | 1/2009 |

(Continued)

OTHER PUBLICATIONS

German Patent Office, German Patent Search Report for Application No. 102012024977.2, dated Aug. 14, 2013.

*Primary Examiner* — Ali Alavi
(74) *Attorney, Agent, or Firm* — Ingrassia Fisher & Lorenz PC

(57) ABSTRACT

A light is provided and a method is provided for manufacturing a light, with a carrier element, an illuminating device disposed on the carrier element with a circuit board and an illuminant mounted on the circuit board, and an optic. The one of the optics and the carrier element comprises at least one positioning element, which passes through an opening in the circuit board and engages in a recess in the other of the optics and the carrier element.

16 Claims, 3 Drawing Sheets

(56) References Cited

U.S. PATENT DOCUMENTS

| | | | | |
|---|---|---|---|---|
| 2003/0156416 | A1 | 8/2003 | Stopa et al. | |
| 2003/0160314 | A1* | 8/2003 | Crane et al. | 257/680 |
| 2004/0183081 | A1* | 9/2004 | Shishov et al. | 257/79 |
| 2008/0117647 | A1* | 5/2008 | Behr et al. | 362/547 |
| 2008/0130308 | A1* | 6/2008 | Behr et al. | 362/507 |

FOREIGN PATENT DOCUMENTS

| | | | |
|---|---|---|---|
| DE | 102009052340 | A1 | 5/2011 |
| WO | 2009067985 | A1 | 6/2009 |
| WO | 2010052135 | A2 | 5/2010 |
| WO | 2011128926 | A1 | 10/2011 |

* cited by examiner

EXTERIOR LIGHT FOR A MOTOR VEHICLE, AND A METHOD FOR MANUFACTURING SUCH A LIGHT

CROSS REFERENCE TO RELATED APPLICATION

This application claims priority to German Patent Application No. 10 2012 024 977.2 filed Dec. 20, 2012, which is incorporated herein by reference in its entirety.

TECHNICAL FIELD

The technical field relates to a light, in particular an exterior light, for a motor vehicle as well as a method for manufacturing such a light and a kit for manufacturing such a light.

BACKGROUND

Exterior lights for motor vehicles such as head lights are these days frequently composed of a plurality of light-emitting diode modules, which are disposed and mounted on a common carrier element. The DE 10 2009 052 340 A1 has disclosed a light-emitting diode module for a motor vehicle illuminating device, which comprises a carrier element and at least one light-emitting diode. The at least one light-emitting diode is mounted and contacted on a lead holder, and the lead holder in turn is mounted and contacted on the carrier element, in order to simplify and standardize the attachment of the light-emitting diode on the light-emitting diode module.

In order to achieve optimal optical conditions in a light, positioning of the illuminant relative to the optics is important. Although it is possible these days to equip circuit boards with light-emitting diodes at negligibly small tolerances, accurate positioning of light-emitting diodes relative to the optical system for conventional lights is, as a rule, relatively cumbersome and thus cost-intensive. This problem needs to be carefully addressed when making changes to the manufacturing process and adapting to changed general conditions (such as changed installation dimensions, beam radiation angle, light outputs, etc.).

In view of the foregoing, it is at least one object to provide an improved light which is easy to adapt to changed general conditions. In addition, other objects, desirable features and characteristics will become apparent from the subsequent summary and detailed description, and the appended claims, taken in conjunction with the accompanying drawings and this background.

SUMMARY

According to an embodiment, a light comprises a carrier element, an optics and an illuminating device arranged between the carrier element and one or more illuminants mounted on the circuit board. One of the optics and the carrier element comprises one or more positioning elements, which pass through an opening in the circuit board and engage in a recess in the other of the optics and the carrier element, in particular pass therethrough. In one embodiment therefore the optics may comprise one or more positioning elements, which pass through one or more openings in the circuit board and engage in one or more recesses in the carrier element, in particular pass therethrough. Additionally or alternatively the carrier element may comprise one or more positioning elements which pass through one or more openings in the circuit board and engage in one or more recesses in the optics, in particular pass therethrough.

A light according to one embodiment is characterized by being of modular construction comprising, in particular, the following components: the carrier element, the illuminating device and the optics. This allows the light to be easily adapted to changed general conditions, by in particular selecting at least one component from a larger available selection of a (construction) kit and/or adapting at least one component.

When using another illuminant for the light, the light properties for example remain frequently essentially unchanged, allowing a uniform optics to be used. In order to adapt the light to the changed package data by using another illuminant, only the carrier element e.g. needs to be slightly adapted, and this can be achieved in a simple and low-cost manner. Instead of providing several different optics or adapting available optics at increased cost, with this embodiment it is sufficient for a change of illuminant, to simply adapt the carrier element.

The at least one illuminant is preferably a light-emitting diode (LED), an organic light-emitting diode (OLED), a group of light-emitting diodes, a LED chip or the like. The illuminating device preferably contains one illuminant, but in terms of the embodiments two, three or more illuminants may be employed in an illuminating device. Different illuminants comprise at least one different property, which is preferably selected from the following: beam radiation angle, radiation surface, light intensity, color location, power input, etc.

The term carrier element in particular describes an element that is suitable for disposing the illuminating device and the optics in a desired position, in particular a desired position within a light housing. The carrier element is preferably plate-shaped, it may be essentially planar, or alternatively bent one or more times. The carrier element is preferably designed to carry several illuminating devices with associated optics. The shape and size of the carrier element are preferably adapted to the desired number and distribution of the illuminating devices.

The term optics in particular describes an element such as a lens, an aperture, a filter, a reflector and such like. The optics preferably comprises a housing, a frame or the like, in particular a holding structure, which holds the at least one optical element in a desired position. An optics is preferably associated with an illuminating device such that at least one optical element of the optics is arranged in the path of the beam downstream of an illuminant of the illuminating device. At least one positioning element is preferably, in particular permanently or detachably, immovably fixed to the optics or the carrier element, i.e., preferably formed in one piece with the holding structure of the optics or molded onto the same (e.g., by injection molding).

In one embodiment the illuminating device can additionally comprise a substrate, and the at least one illuminant may be attached to the circuit board with this substrate, or may be mounted to the circuit board via this substrate. The use of such a substrate allows for different illuminants to be mounted on a circuit board in a simple way.

According to one embodiment the substrate of the illuminating device may be a substrate selected from several different substrates corresponding to the at least one selected illuminant, and/or may be adapted to the at least one selected illuminant. With the aid of a substrate adapted to the respective illuminant the at least one illuminant can be mounted on a (preferably essentially uniform) circuit board in a simple way. This can further enhance the modularity of this embodiment of the light.

In one embodiment the carrier element can comprise, on its side facing the illuminating device, an adaption recess for at least partially receiving the illuminating device. Provision of such an adaption recess in the carrier element makes it possible, in a simple way, to mount different illuminating devices on a circuit board. With the aid of an adaption recess adapted to the respective illuminant the illuminating device can be mounted in a simple way on a carrier element, in particular an initially essentially uniform carrier element. This can further increase the modularity of this embodiment of the light. The dimensions of the adaption recess, in this embodiment, are preferably adapted to the respective illuminating device. In this context the adaption recess may comprise a depth of zero, i.e., be non-existing, depending upon the illuminating device. An adaption recess may, in particular, be cast in one with the carrier or be manufactured subsequently, in particular by machining.

The at least one positioning element, in one embodiment, can comprise at least one mounting pin provided on the optics, which pin engages in a bore in the circuit board, the substrate and/or the carrier element. In one embodiment three or four mounting pins and a corresponding number of bores are provided, in order to ensure positioning which is as accurate and reproducible as possible; but less than three or more than four mounting pins may be alternatively provided.

Preferably the illuminating device is arranged on the carrier element in such a way that the bores of the two components are essentially positioned so as to be in alignment with each other so that a mounting pin of the optics can engage in the bores of both components. With this embodiment the mounting pin of the optics preferably extends through the bore in the carrier element and is, on the side of the carrier element facing away from the optics, attached by a fixing element, in particular by reshaping the mounting pin. Reshaping preferably means that the mounting pin is reshaped by a process of stamping, in particular hot-stamping, welding, in particular hot-welding, bending, clinching, riveting, etc. According to one embodiment the carrier element is at least partially configured as a cooling body or provided with such a cooling body. Preferably the carrier element is configured as an aluminium die casting for this purpose.

According to a further embodiment the method for manufacturing a light comprises the following steps: attaching or mounting the at least one illuminant on a circuit board of an illuminating device; disposing this illuminating device on a carrier element; and positioning an optics in a predefined position relative to the illuminating device in that at least one positioning element of one of the optics and the carrier element passes through an opening in the circuit board and engages in a recess in the other of the optics and the carrier element.

This method is preferably used for manufacturing the above described light. Using this method allows the same advantages to be achieved as with the above-described light. In one embodiment the at least one illuminant can be attached or mounted on the circuit board via or with a substrate.

The at least one illuminant, in this embodiment, can be selected from several different illuminants. The substrate can then be selected from several different substrates corresponding to the at least one selected illuminant and/or can be adapted to at least one selected illuminant. In one embodiment the at least one illuminant can be selected from several different illuminants, and the carrier element can be adapted to the illuminating device corresponding to the at least one selected illuminant. Additionally or alternatively the optics can be elected from several different optics. The carrier element, in one embodiment, can be provided with an adaption recess corresponding to the at least one selected illuminant for at least partially receiving the illuminating device therein.

In one embodiment the at least one positioning element may comprise at least one mounting pin provided on the optics, which pin, during positioning of the optics, engages in a bore in the circuit board, the substrate and/or the carrier element. The mounting pin of the optics, with this embodiment, may be passed through the bore in the carrier element during positioning of the optics and attached, in particular by reshaping it, on the side of the carrier element facing away from the optics.

According to a embodiment a (construction) kit for manufacturing a light comprises a circuit board, several different illuminants, a carrier element for attaching an illuminating device formed of a circuit board and at least one illuminant, and an optics which can be positioned with the aid of at least one positioning element in a predefined position relative to the illuminating device. Additionally or alternatively to the selection of different illuminants the (construction) kit may comprise several different optics from which one is selected corresponding to the illuminating device, in particular its illuminants, and positioned. Using this kit a light of the above description can preferably be manufactured. With this (construction) kit the same advantages can be achieved as with the above-described embodiment of a light.

In one embodiment the kit may comprise several different substrates for mounting at least one illuminant on the circuit board. The light, the manufacturing process and the (construction) kit can all be used, respectively, for an exterior light of a motor vehicle, preferably for a motor vehicle headlight.

BRIEF DESCRIPTION OF THE DRAWINGS

The present invention will hereinafter be described in conjunction with the following drawing figures, wherein like numerals denote like elements, and.

DETAILED DESCRIPTION

The following detailed description is merely exemplary in nature and is not intended to limit application and uses. Furthermore, there is no intention to be bound by any theory presented in the preceding background or summary or the following detailed description.

Figure 1:
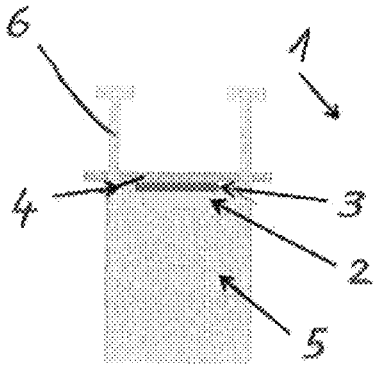
FIG. 1 is a partial cross-sectional view of a light according to an embodiment.

FIG. 1 shows an example of part of a motor vehicle headlight according to a first embodiment. The headlight comprises a plate-shaped carrier element 1, which is manufactured as an aluminium casting and thus simultaneously serves as a cooling body. The carrier element 1 carries a number of light-emitting diode modules as requested by the vehicle manufacturer and disposed as requested by him, but where only one such module is shown in FIG. 1.

On one side of the carrier element 1 (at the bottom in FIG. 1) an illuminating device is arranged. This illuminating device comprises an illuminant 2, preferably a light-emitting diode (LED) or a LED chip. This illuminant 2 is mounted, i.e., mechanically attached and electrically contacted, to a circuit board 4 via a substrate 3. The illuminant 2 can be mounted on the circuit board 4 with conventional means and at negligibly small tolerances. The illuminating device 2-4 and in particular its illuminant 2 is associated with an optics 5. The optics 5 comprises a housing which holds a reflector and a lens as optical elements.

The optics housing has several positioning elements 6 in the form of mounting pins molded onto it. These positioning elements 6 allow the optics 5 to be accurately and reproducibly positioned relative to the illuminating device 2-4 and to the carrier element 1. The optics 5 receives the illuminating device 2-4 between itself and the carrier element 1.

Assembly of this light will now be explained in detail with reference to FIGS. 2A-C. After the illuminating device 2-4 has been formed by mounting a light-emitting diode 2 via a substrate on the circuit board 4, this illuminating device 2-4 is disposed on the carrier element 1 (See FIG. 2A).

Figure 2A:
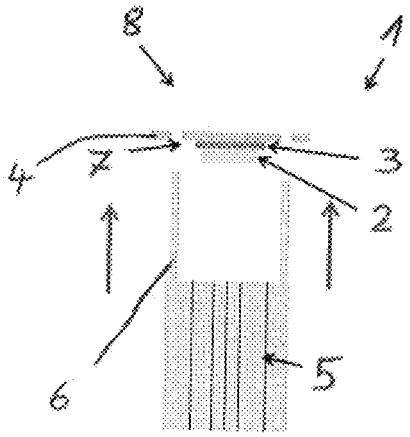
FIG. 2A is a partial cross-sectional view of a first assembly stage of the light according to FIG. 1.

As illustrated in FIG. 2A, several bores 7 are provided in the circuit board 4 and several bores 8 are provided in the carrier element 1. The illuminating device 2-4 is arranged on the carrier element 1 such that the bores 7 in the circuit board 4 and the bores 8 in the carrier element 1 are in alignment with each other. Preferably the bores 7 and 8 have essentially the same diameter and are disposed congruent with each other.

Figure 3:
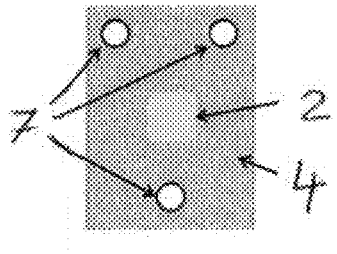
FIG. 3 is a top view of an illuminating device of the light according to FIG. 1.

The number of bores 7, 8 in the circuit board 4/in the carrier element 1 coincide with each other and with the number of positioning elements 6 of the optics 5. As illustrated in FIG. 3 preferably three bores 7, 8 for three mounting pins 6 are provided. The bores 7, 8 are all shaped as fitting bores, i.e., their diameter is only slightly larger than the diameter of the mounting pins 6 of the optics 5.

Figure 2B:
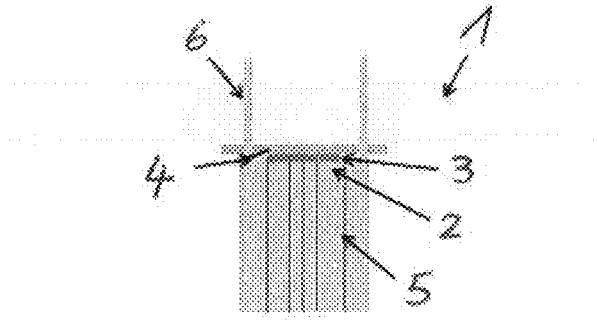
FIG. 2B is a partial cross-sectional view of a second assembly stage of the light according to FIG. 1.
Figure 2C:
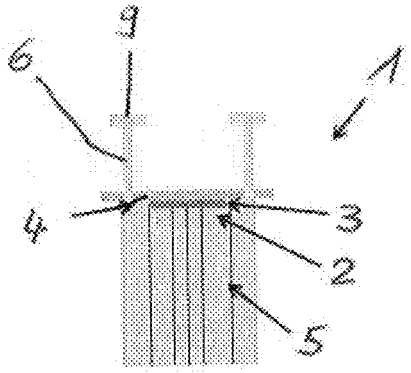
FIG. 2C is a partial cross-sectional view of a third assembly stage of the light according to FIG. 1.

The optics 5 is pushed onto the illuminating device 2-4 with its mounting pins 6 until it is firmly seated on it (See FIG. 2B). Due to the three mounting pins engaging in the bores 7, 8 the optics is positioned relative to, and aligned with, the illuminant 2 so as to ensure a precise fit.

The mounting pins 6 of the optics 5 are dimensioned such that in this state of assembly they protrude through the bores 8 in the carrier element 1 (See FIG. 2B). As indicated in FIG. 2B, the ends of the mounting pins 6 are then reshaped, for example by a process of hot-stamping. In this way the optics 5 is fixed on the carrier element 1 and also attached in its exact position relative to the illuminating device 2-4. The above-described construction of the headlight is characterized by its high modularity, which permits easy adaption to suit changed general conditions.

As an example, for an LED change during running production due to, e.g., end-of-life, supply shortage, or similar, there is the problem with conventional systems that although the optical properties of the LED chip are essentially the same (e.g. Lambertian spotlight), the package data does not match the optical surfaces. With conventional systems the layout of the optics had to be changed in such a case. By contrast, the modular light in the described embodiment makes it possible, to carry out a small adaption of the carrier element 1 to suit the new conditions, at only a small amount of expense.

Figure 4:
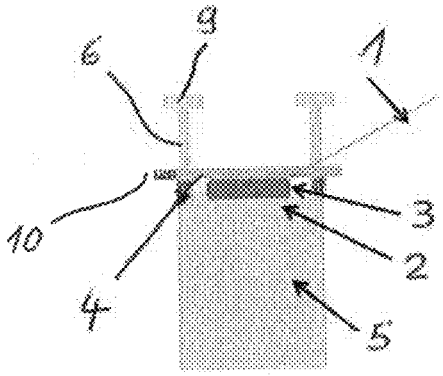
FIG. 4 is a partial cross-sectional view of a light of a further embodiment.

As illustrated in FIG. 4, the light in this embodiment contains another light-emitting diode 2 which is of a greater constructional height. The substrate 3 in this case has been adapted to suit the selected light-emitting diode 2 and is also of a greater constructional height. In order to assemble this changed illuminating device 2-4 without modification to the optics 5, a recess is milled into the carrier element 1. This recess 10 is dimensioned such that it can receive the illuminating device 2-4 to a certain extent.

The milled recess 10 in FIG. 4 the non-existing recess in FIG. 1 forms an adaption recess. Due to the above-described modularization of the light a distinct cost reduction in the production process of the light such as, e.g., motor vehicle headlights may result. All that needs to be provided are different illuminants 2 and correspondingly different substrates 3, whilst the optics 5 can remain the same throughout, and the carrier element 1 requires being adapted to only a minor extent.

Although exemplary embodiments have been discussed in the above description, it is pointed out that a multitude of variations is possible. Besides it is pointed out that the exemplary embodiments are merely examples and not intended to limit the scope of protection, the applications and the construction in any way. Rather the above description is meant to be a guideline for the expert to help realize at least one exemplary embodiment, wherein various changes, in particular in view of the function and layout of the described components, can be carried out without leaving the scope of the protection, as revealed in the claims and these equivalent feature combinations.

What is claimed is:

1. An exterior light for a motor vehicle, comprising:

a carrier element;

an optics;

an illuminating device arranged between the carrier element and the optics with a circuit board and an illuminant attached the circuit board; and a positioning element that passes through an opening in the circuit board and engages in a recess;

wherein the positioning element comprises a mounting pin on the optics that engages in a bore in the circuit board:

wherein the mounting pin of the optics extends through the bore in the carrier element and on a side of the carrier element facing away from the optics is attached by a fixing element, in particular a reshaping of the mounting pin.

2. The light according to claim 1, wherein the illuminating device comprises a substrate and the illuminant is attached with the substrate on the circuit board.

3. The light according to claim 1, wherein the carrier element on the side facing the illuminating device comprises an adaption recess that at least partially receives the illuminating device.

4. The light according to claim 1, wherein the carrier element is configured at least partially as a cooling body.

5. A method for manufacturing an exterior light for a motor vehicle, comprising:

attaching an illuminant to a circuit board of an illuminating device;

disposing the illuminating device on a carrier element and between the carrier element and an optics with the circuit board and the illuminant attached to the circuit board; and positioning the optics in a predefined position relative to the illuminating device in that a positioning element passes through an opening in the circuit board and engages in a recess;

wherein the positioning element comprises a mounting pin on the optics that engages in a bore in the circuit board.

6. The method according to claim 5, wherein the positioning element comprises a mounting pin provided on the optics, the pin configured to engage in a bore.

7. The method according to claim 6, wherein the mounting pin of the optics is passed through the bore in the carrier element, during positioning of the optics and attached to the side of the carrier element that faces away from the optics.

8. The method according to claim 5, further comprising attaching the illuminant to the circuit board with a substrate.

9. The method according to claim 8, wherein the illuminant is selected from several different illuminants and the substrate is selected corresponding to the at least one selected illuminant from several different substrates.

10. The method according to claim 5, wherein the illuminant is selected from several different illuminants.

11. The method according to claim 10, wherein the carrier element is configured for the illuminant to the illuminating device, wherein the carrier element in particular, on a side facing the illuminating device, is provided with an adaption recess according to the illuminant for at least partially receiving the illuminating device therein.

12. A kit for manufacturing an exterior light for a motor vehicle, comprising;

a circuit board;

several different illuminants;

several different optics;

a carrier element for attaching a illuminating device formed of the circuit board and at least one of the several different illuminants;

wherein at least one of the several different optics positionable in a predefined position relative to the illuminating device with the aid of a positioning element;

wherein the positioning element comprises a mounting pin on the optics that engages in a bore in the substrate;

wherein the fixing element is a reshaping of the mounting pin.

13. The kit according to claim 12, wherein the carrier element is provided with a cooling body.

14. The kit according to claim 12, wherein the at least one illuminant is selected from several different illuminants and the substrate is adapted to the at least one selected illuminant.

15. The method kit according to claim 12, wherein the optics is selected from several different optics.

16. The kit according to claim 12, further comprising several different substrates that are configured to mount at least one of the several illuminants on the circuit board.

* * * * *